United States Patent [19]

Cleall

[11] 4,337,898

[45] Jul. 6, 1982

[54] BURNER HEADS

[75] Inventor: Alfred F. Cleall, Warnham, England

[73] Assignee: Babcock Product Engineering Ltd., Sussex, England

[21] Appl. No.: 169,155

[22] Filed: Jul. 15, 1980

[30] Foreign Application Priority Data

Jul. 17, 1979 [GB] United Kingdom ..... 7924826

[51] Int. Cl.[3] ..... F23D 11/16

[52] U.S. Cl. ..... 239/422; 239/428; 239/429; 239/433

[58] Field of Search ..... 239/422, 428, 429, 426, 239/431, 433, 434, 8

[56] References Cited

U.S. PATENT DOCUMENTS 2,933,259 4/1960 Raskin ..... 239/426

4,141,505 2/1979 Reich ..... 239/431

FOREIGN PATENT DOCUMENTS 7706796 12/1978 Netherlands ..... 239/422

*Primary Examiner*—Robert B. Reeves

*Assistant Examiner*—Michael J. Forman

*Attorney, Agent, or Firm*—Kemon & Estabrook

[57] ABSTRACT

This invention provides a burner head that may be used for the discharge of a mixture of steam and oil. Steam bores 10 penetrate the head from one end to the other. Oil ducts 11 lead to each bore 10 from one end of the head. One or more further ducts 13 lead from the rear end of the head to a chamber 2,20 formed at the front end of the head and additional oil ducts 12 lead back from the chamber to discharge one into each of the bores 10. The two ducts 11 and 12 that discharge into any bore are directed towards each other.

4 Claims, 1 Drawing Figure

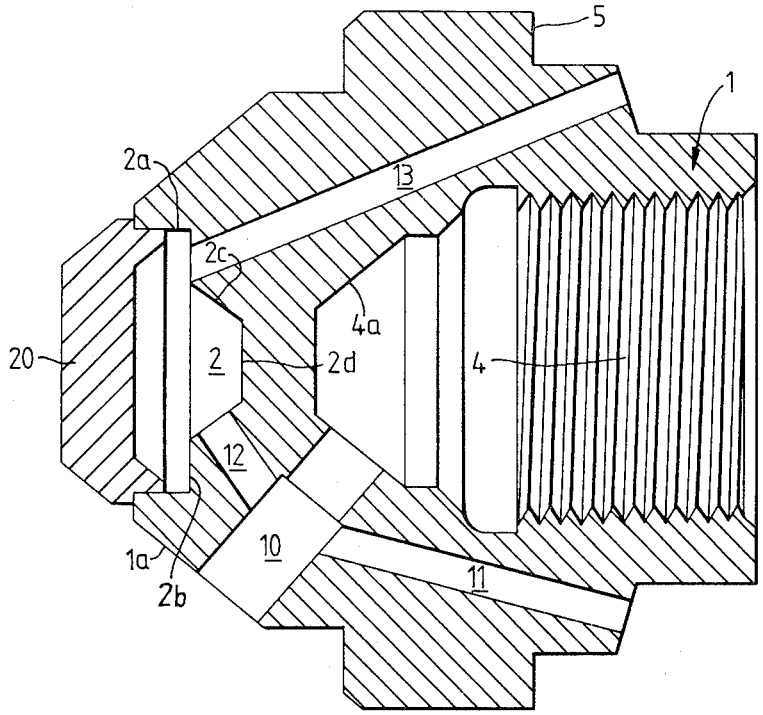
5
1
2a
13
2c
4a
20
2
2d
4
12
10
1a
2b
11

BURNER HEADS

DESCRIPTION

This invention relates to burners for use in furnaces and arose from a consideration of the functioning of burners of the kind that has a head through which streams of steam pass and into which streams, within the head, fuel oil is discharged. It has been realised that advantages can be derived by arranging that the oil that is discharged into any stream of steam is discharged from two paths directed towards each other across the steam stream. The impact of the oil streams on each other facilitates mixing and results in less erosion than would tend to result from the impact of the oil on the wall of the channel through which the steam passes.

According to the invention there is provided a burner head comprising a body part and, at one end of the body part, a chamber formed by the body part and a cap that has been sealingly welded around its periphery to the body part, the body part having a plurality of straight bores extending to the end at which the chamber is formed from the other end and diverging from each other towards the chamber end, the body part also containing, for each bore, two straight ducts of which the axes meet in the bore, one duct leading to the bore from the end of the body part remote from the chamber and the other duct leading to the bore from the surface of the body part that is included in the boundaries of the chamber, and one or more further ducts extending through the body part to the chamber from the end of the body part remote from the chamber.

By way of example an embodiment of the invention will now be described with reference to the accompanying drawing which shows two half axial sections through a burner head, the lower half being displaced relatively to the upper half through 15° about the axis.

The major part of the head is constituted by the generally cylindrical block 1 forming the body part. A recess 2 is formed in the front, furnace, end. The recess 2 is bounded by a cylindrical wall 2*a*, an annular wall 2*b* perpendicular to that, a frusto-conical wall 2*c* of which the semi-vertical angle is 30°, and a flat end wall 2*d* parallel to the wall 2*b*.

A further recess 4 is formed in the other end of the head 1, the inner end of this recess 4 including a frusto-conical wall 4*a* having a semi-conical angle of 40°.

In use, the head is fixed to the end of a burner providing two concentric barrels (not shown). One of the barrels is received in the recess 4 and serves to lead steam to the head whilst the other fits around the head and abuts the shoulder 5, forming with the first barrel an annular space through which oil flows to the head.

To permit steam to pass through the head from the recess 4, there are provided twelve equi-angularly distributed bores 10 which diverge from each other in the direction of the recess 2. Each bore 10 is straight and formed by drilling perpendicularly to the bevelled surface 1*a* formed at the front end of the head. To permit oil to pass through the head from the annular space, ducts are provided and the ducts are also formed by drilling. The oil ducts are denoted by 11, 12 and 13. Ducts 11 are formed by drilling from the rear end of the block 1 and ducts 12 are formed by drilling from the front end of the block 1 perpendicular to the wall 2*c*. The ducts 11 and 12 both open into the bore 10, the axes of the three lie in a common axial plane with the axes of the ducts 11 and 12 converging towards, and meeting on, the axis of the bore 10. The ducts 13 each lie midway between two adjacent bores 10 and lead from the rear end of the block 1 to the wall 2*b*. It will be seen that, corresponding to the arrangement of barrels that has been mentioned, the inlet ends of the ducts 11 and 13 lie on a ring that lies radially outwardly of the ring on which the inlet ends of the bores 10 lie.

After the bores 10 and ducts 11, 12 and 13 have been made, a cap 20 is welded around its edge to the front end of the block 1 to close the recess 2 and form a chamber.

In use of the burner head, steam is supplied to the recess 4 through the central of the two barrels that have been mentioned and discharges in divergent streams through the bores 10. At the same time oil is supplied along the annulus that surrounds the barrel and flows into the ducts 11 and 13. Oil flowing through the former will discharge directly into a steam stream whilst oil flowing through the latter will discharge into the common chamber defined by the recess 2 and cap 20 and flow thence into a duct 12. From the duct 12, the oil will discharge into a bore 10. The two streams of oil will collide within the bore 10, rather then impinge on the wall of the bore, with the result that mixing within the bore is efficient whilst wall erosion is restricted. These advantages are, moreover, achieved by the use of passages that can be formed by drilling from one end or the other of the blocks.

Whilst in the embodiment cited there are as many ducts 13 as there are bores 10, a larger or smaller number, perhaps only one, might be provided.

I claim:

1. A burner head comprising a body part and, at one end of the body part, a chamber formed by the body part and a cap that has been sealingly welded around its periphery to the body part, the body part having a plurality of straight bores extending to the end at which the chamber is formed from the other end and diverging from each other towards the chamber end, the body part also containing, for each bore, two straight ducts having longitudinal axes that meet in the bore, one duct leading to the bore from the end of the body part remote from the chamber and the other duct leading to the bore from the chamber, and one or more further ducts extending through the body part to the chamber from the end of the body part remote from the chamber, said straight bores adapted to communicate with a first fluid source and said straight ducts and said further ducts adapted to communicate with a second fluid source.

2. A burner head as claimed in claim 1 in which the chamber is formed by a recess in the body part and a cap that covers the recess, the end of the recess remote from the cap providing an annular bevel and each of the ducts that leads from the recess to a bore being perpendicular to the surface of the bevel.

3. A burner head as claimed in either of the preceding claims in which the axes of the two ducts that meet in any bore lie in a plane and converge in the direction of the outlet end of the bore.

4. A burner head as claimed in claim 1 in which the end or ends of the further duct or ducts and the ends of the ducts that lead to bores from the end of the body part remote from the chamber lie on a ring that lies radially outwardly of the ends of the bore that lie at the end of the body part remote from the chamber.

* * * * *